US007446789B2

(12) United States Patent
Nakata et al.

(10) Patent No.: US 7,446,789 B2
(45) Date of Patent: Nov. 4, 2008

(54) HEAT ACCUMULATION CORRECTING METHOD, THERMAL PRINTER, AND COMPUTER-EXECUTABLE PROGRAM

(75) Inventors: Hajime Nakata, Saitama (JP); Takeaki Hashimoto, Saitama (JP)

(73) Assignee: FUJIFILM Corporation, Tokyo (JP)

( * ) Notice: Subject to any disclaimer, the term of this patent is extended or adjusted under 35 U.S.C. 154(b) by 163 days.

(21) Appl. No.: 11/392,740

(22) Filed: Mar. 30, 2006

(65) Prior Publication Data

US 2006/0232658 A1 Oct. 19, 2006

(30) Foreign Application Priority Data

Mar. 30, 2005 (JP) ..... 2005-099205

(51) Int. Cl.
*B41J 2/335* (2006.01)

(52) U.S. Cl. ..... 347/209

(58) Field of Classification Search ..... 347/218, 347/211, 196, 195, 194, 190, 189, 188, 186, 347/185

See application file for complete search history.

(56) References Cited

U.S. PATENT DOCUMENTS

| | | | | |
|---|---|---|---|---|
| 5,539,443 | A | 7/1996 | Mushika et al. | |
| 5,646,672 | A * | 7/1997 | Fukushima | 347/211 |
| 5,841,461 | A | 11/1998 | Katsuma | |
| 6,108,019 | A * | 8/2000 | Katsuma et al. | 347/188 |
| 6,494,629 | B2 | 12/2002 | Hayashi et al. | |
| 6,747,683 | B2 * | 6/2004 | Nakajima et al. | 347/211 |

FOREIGN PATENT DOCUMENTS

| | | | |
|---|---|---|---|
| JP | 6-158863 | A | 1/1994 |
| JP | 7-223334 | A | 8/1995 |
| JP | 9-52382 | A | 2/1997 |
| JP | 10-146998 | A | 6/1998 |
| JP | 2000-71506 | A | 3/2000 |
| JP | 2000-108399 | A | 4/2000 |
| JP | 2001-270144 | A | 10/2001 |
| JP | 2002-166588 | A | 6/2002 |

* cited by examiner

*Primary Examiner*—K. Feggins
(74) *Attorney, Agent, or Firm*—Sughrue Mion, PLLC

(57) ABSTRACT

A thermal head in a thermal printer has heating elements, a glaze layer and a ceramic board. Equations are used for correcting heat accumulation.

$$Eg1(M+1,N)=(1-k1).E(M,N)+(1-k2).Eg1(M,N)$$

$$Eg2(M+1,N)=k2(1-k3)(1-k4).Eg1(M,N)$$

$$Ec1(M+1,N)=k2(1-k3).k4.Eg1(M,N)+(1-k5).Ec1(M,N)$$

E(M,N): heat data of an Nth pixel of an Mth line after heat accumulation correction;

Eg1(M,N): accumulated heat data of the glaze layer at point Pg1 and obtained in the correction of an (M−1)th line;

Eg2(M,N): accumulated heat data of the glaze layer at point Pg2 and obtained in the correction of the (M−1)th line;

Ec1(M,N): accumulated heat data of the ceramic board at point Pc1 and obtained in the correction of the (M−1)th line.

20 Claims, 6 Drawing Sheets

HEAT ACCUMULATION CORRECTING METHOD, THERMAL PRINTER, AND COMPUTER-EXECUTABLE PROGRAM

BACKGROUND OF THE INVENTION

1. Field of the Invention

The present invention relates to a heat accumulation correcting method, a thermal printer, and a computer-executable program. More particularly, the present invention relates to a heat accumulation correcting method used with a thermal printer for preventing an image quality from being degraded by accumulated heat of a heating element, and a thermal printer, and a computer-executable program.

2. Description Related to the Prior Art

There are a direct thermal recording type of thermal printer and a thermal transfer recording type of thermal printer. The direct thermal recording heats a thermosensitive recording material with a thermal head to directly develop color. The thermal transfer recording heats the back side of an ink ribbon placed upon a recording material to transfer ink in the ink ribbon to a recording material. A thermal head has a number of heating elements disposed on a ceramic board.

It is general in a thermal printer that no image can be recorded with high fidelity if the thermal head is driven directly according to input image data. This is because irregularity in density or unsharp state of an image contour is likely to occur in a printed image due to heat accumulation.

Part of the heat energy accumulated in a heating element contributes to recording a pixel. However, remaining heat energy short of developing color may be dissipated or accumulated in a glaze layer where the heating elements are located. Heat energy accumulated in the glaze layer may be conducted to a ceramic board for supporting the glaze layer, and may remain therein. Also, heat energy accumulated in the ceramic board may be conducted to the aluminum panel for supporting the ceramic board, and may remain therein, and also may be conducted to a plate of a heat sink secured to the aluminum panel, and may dissipate. It is likely that part of accumulated heat in any of the glaze layer, the ceramic board and the aluminum panel in the thermal head conducts back to the heating elements, and causes unwanted influence to the recording of a succeeding line.

Part of accumulated heat in the layers of the thermal head influences recording of pixels. Therefore, color developing density may be higher than an expected level. If one first portion on an original image has shape in with a distinct change in the density from a dark color to a light color, the first portion viewed on an obtained hard copy is likely to have an unsharp change in the density. Recording of the contours is impossible in a sharp manner. Also, the heat accumulation causes a phenomenon of shading, in which density is rather low at the start of the printing, and density will raise in the course of the printing due to heat accumulation within the heating elements. The farther the recording proceeds, the more the amount of accumulated heat in the heating elements, to cause the shading.

Ideas to prevent drop in the image quality according to the heat accumulation correction are disclosed in U.S. Pat. No. 5,539,443 (corresponding to JP-A 6-015863), U.S. Pat. No. 5,841,461 (corresponding to JP-A 9-052382), JP-A 7-223334, JP-A 2000-071506, JP-A 2000-108399 and JP-A 2002-166588. A thermal printer of those documents has a thermal head including a layer of heat accumulation, and in which a function of first order delay, a function of second order delay, a linear function or other suitable methods are used for the purpose.

A printing speed is an important factor in performance of a thermal printer or other types of printers, and specifically for commercial use to sell prints as products. Correcting methods with higher precision than before are suggested in further improved techniques, for example JP-A 10-146998 and U.S. Pat. No. 6,494,629 (corresponding to JP-A 2001-270144). An algorithm for the correction is in consideration of a use of plural heat accumulating layers. The layers are elements combined together for constituting a thermal head. Those are multi step correction of heat accumulation as a new conception over single step correction of heat accumulation so far suggested.

Although thermal history correction of a multi step type has higher precision than that of a single step type, there remains a problem in that precision of the correction near to the rear edge of the printing region is lower in a large size print than the L-size print. Examples of the large size print is 2L or 3L having greater areas than the L size. This is because their size in the sub scan direction is greater than the of the L size.

SUMMARY OF THE INVENTION

In view of the foregoing problems, an object of the present invention is to provide a heat accumulation correcting method in which influence due to heat accumulation can be eliminated by raising precision in the correction specifically when a printing size is such a large size as 2L or 3L, and a thermal printer, and a computer-executable program.

In order to achieve the above and other objects and advantages of this invention, a heat accumulation correcting method of correcting heat accumulation of a thermal head for thermal recording is provided. The thermal head has an array of heating elements arranged in a main scan direction, for image recording on recording material by one line in driving of the heating elements according to heat data, wherein one of the thermal head and the recording material is moved relative to a remaining one thereof in a sub scan direction in recording of the line. The thermal head has first to Lth heat accumulating layers lying over one another, the first layer having the heating elements thereon. A first specific point of the first to Lth layers is predetermined commonly behind the heating elements in a thickness direction thereof, and a second specific point is predetermined in at least one of the first to Lth layers and offset from the first specific point in the sub scan direction. In the method, initial heat data of an Mth line, and heat accumulation correcting data for the first and second specific points in the first to Lth layers in relation to the Mth line are processed to determine the heat data adapted to driving the heating elements to print the Mth line. The determined heat data and accumulated heat data related to heat accumulation of the first and second specific points of the first to Lth layers in printing the Mth line, are processed according to a predetermined linear function, to determine accumulated heat data of the first and second specific points of the first to Lth layers for the (M+1)th line, and for multiplying the accumulated heat data by a coefficient, to determine heat accumulation correcting data for the (M+1)th line.

The first to Lth heat accumulation correcting data for the Mth line are subtracted from the initial heat data of the Mth line at respective pixels, and a difference of the subtraction is divided by a coefficient, to determine the heat data.

While the Mth line is recorded, the heat data of the (M+1)th line among plural lines to be recorded is corrected for heat accumulation correction according to the accumulated heat data.

The accumulated heat data include first accumulated heat data related to estimated heat accumulation at the first specific point and within the first layer. Second accumulated heat data is related to estimated heat accumulation at the second specific point and within the first layer. Third accumulated heat data is related to estimated heat accumulation at one specific point, within the second layer and behind the first specific point. The processing step to determine the accumulated heat data includes updating the first accumulated heat data by processing according to the initial heat data and a linear function. The second accumulated heat data is updated by processing according to the first accumulated heat data and a linear function. The third accumulated heat data is updated by processing according to the first accumulated heat data and a linear function, wherein the heat accumulation correcting data for the (M+1)th line is determined according to at least the first, second and third accumulated heat data after updating.

In one preferred embodiment, in consideration of initial heat data of an Mth line, and heat accumulation correcting data for the first specific point in the first to Lth layers in relation to the Mth line, and heat accumulation correcting data for the second specific point in relation to the Mth line, determining the heat data adapted to driving the heating elements to print the Mth line. The determined heat data and accumulated heat data Eg1 related to heat accumulation of the first specific point of the first layer in printing the Mth line, are processed according to a predetermined linear function, to determine accumulated heat data Eg1 related to heat accumulation of the first specific point of the first layer for an (M+1)th line, and for multiplying the accumulated heat data Eg1 by a coefficient, to determine first heat accumulation correcting data for the (M+1)th line. Accumulated heat data Ec1 related to heat accumulation of the first specific point of a Pth one of the layers, and accumulated heat data E01 related to heat accumulation of the first specific point of a (P−1)th one of the layers, are processed according to a predetermined linear function, to determine accumulated heat data Ec1 of the first specific point for the (M+1)th line, and for multiplying the accumulated heat data Ec1 by a coefficient, to determine Pth heat accumulation correcting data for the (M+1)th line, where P is one integer from 2 to L−1. Accumulated heat data Eg1 related to the heat accumulation of the first specific point of the first layer, and accumulated heat data Eg2 related to heat accumulation of the second specific point of the first layer, are processed according to a predetermined linear function, to determine accumulated heat data Eg2 of the second specific point for the (M+1)th line. Also, accumulated heat data Ec1 related to heat accumulation of the first specific point of the Pth layer, and accumulated heat data Ec2 related to heat accumulation of the second specific point of the Pth layer, and accumulated heat data E02 related to heat accumulation of the second specific point of the (P−1)th layer, are processed according to a predetermined linear function, to determine accumulated heat data Ec2 of the second specific point for the (M+1)th line. Accumulated heat data Ea1 related to heat accumulation of the first specific point of the Lth layer, and accumulated heat data E11 and E12 related to heat accumulation of the first and second specific points of the (L−1)th layer, are processed according to a predetermined linear function, to determine accumulated heat data Ea1 of the first specific point for the (M+1)th line, and for multiplying the accumulated heat data Ea1 by a coefficient, to determine Lth heat accumulation correcting data for the (M+1)th line.

Preferably, L=3 and P=2, the first layer is a glaze layer, the second layer is a ceramic board, and the third layer is a panel of metal.

Preferably, a thermal printer includes a heat accumulation corrector, responsive to initial heat data of an Mth line, and heat accumulation correcting data for the first and second specific points in the first to Lth layers in relation to the Mth line, for determining the heat data adapted to driving the heating elements to print the Mth line. A determiner is responsive to the determined heat data and accumulated heat data related to heat accumulation of the first and second specific points of the first to Lth layers in printing the Mth line, for processing thereof according to a predetermined linear function, to determine accumulated heat data of the first and second specific points of the first to Lth layers for the (M+1)th line. A multiplier multiplies the accumulated heat data by a coefficient, to determine heat accumulation correcting data for the (M+1)th line.

Furthermore, a heat accumulation correcting computer-executable program for correcting heat accumulation of a thermal head for thermal recording is provided. In a manner similar to the method and the thermal printer, the heat accumulation correcting computer-executable program includes a heat accumulation correcting code, a determining code, and a multiplying code.

Preferably, the initial heat data of the Mth line is corrected for heat accumulation correction at respective pixels according to first, second and third accumulated heat data, to determine the heat data of the Mth line to be recorded, wherein the first accumulated heat data is related to estimated accumulated heat at a first specific point being positioned within the first layer and behind the heating elements, and the second accumulated heat data is related to estimated accumulated heat at a second specific point being positioned within the first layer and offset from the first specific point in the sub scan direction, and the third accumulated heat data is related to estimated accumulated heat at one specific point being positioned within the second layer and behind the first specific point. The first accumulated heat data is updated by processing according to the initial heat data and a linear function. The second accumulated heat data is updated by processing according to the first accumulated heat data and a linear function. The third accumulated heat data is updated by processing according to the first accumulated heat data and a linear function. The initial heat data of the (M+1)th line is corrected for heat accumulation correction at respective pixels according to the first, second and third accumulated heat data after updating, to determine the heat data of the (M+1)th line to be recorded.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 2:
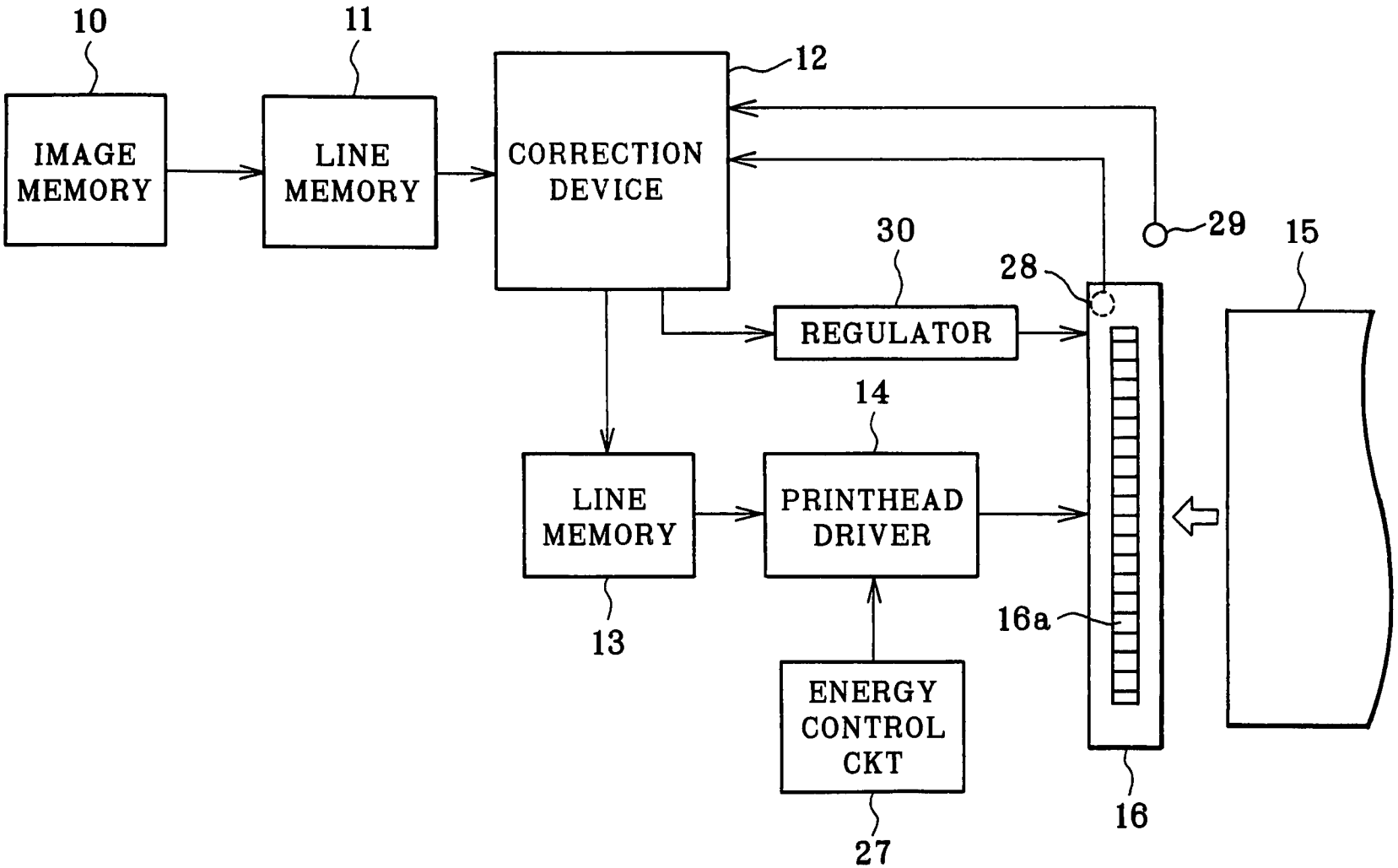
FIG. 2 is a block diagram schematically illustrating a color thermal printer.

In FIG. 2, a color thermal printer of the invention is illustrated. Images to be printed are created and input by a digital camera, scanner, or other optical instruments. An image memory 10 of the printer stores the input images in forms of yellow, magenta and cyan image data. In the printing operation, image data are read from the image memory 10 by one line. A line memory 11 is connected, to which the image data is written to the line memory 11 by one line.

The image data of respective lines are read from the line memory 11. A correction device 12 is supplied with the image data of the lines. As will be described in detail, the image data is converted to initial heat data representing heat energy for coloring, and is subjected in the correction device 12 to correction of accumulated heat. After the correction, the heat data is converted to image data. A line memory 13 is connected, to which the image data is written.

A printhead driver 14 is connected with the line memory 13. For one-line recording, image data of one line is sent by the line memory 13 to the printhead driver 14. A printhead or thermal head 16 is connected with the printhead driver 14. A color thermosensitive recording sheet 15 or material is pressed by the thermal head 16, which the printhead driver 14 drives. The recording material 15 is a full-color type known in the art, and includes yellow, magenta and cyan thermosensitive coloring layers overlaid on a support. Ultraviolet rays of specific wavelengths are applied to the recording material 15, to destroy ability of coloring of the yellow and magenta coloring layers.

A transporting mechanism (not shown) moves the recording material 15 back and forth in the sub scan direction in FIG. 2. Yellow, magenta and cyan images are recorded by three times of back and forth movement according to three-color frame-sequential recording to obtain a full-color image. After yellow recording and after magenta recording, a photo fixer (not shown) is operated to emit ultraviolet rays, to fix the color image by destroying ability of coloring of the yellow and magenta coloring layers.

Thermal recording in a direct type performs bias heating, and image heating that is gradation heating to record a dot of one color. The bias heating is to heat the recording material 15 up to a heated state short of color development of the corresponding coloring layer at which the color begins to develop. For the bias heating, all heating elements 16*a* of the thermal head 16 are equally heated by bias data. The bias data principally represents the same value for all heating elements, and is determined for each color according to the coloring characteristics of the individual coloring layer. However, if there is any variance between resistance values of the heating elements 16*a*, the bias data is adjusted to compensate for the variance. In the image heating, the heating elements 16*a* are driven according to the image data, to apply image heat energy to the recording material 15 according to the image data. The coloring layers are colored at densities of the image data.

Figure 3:
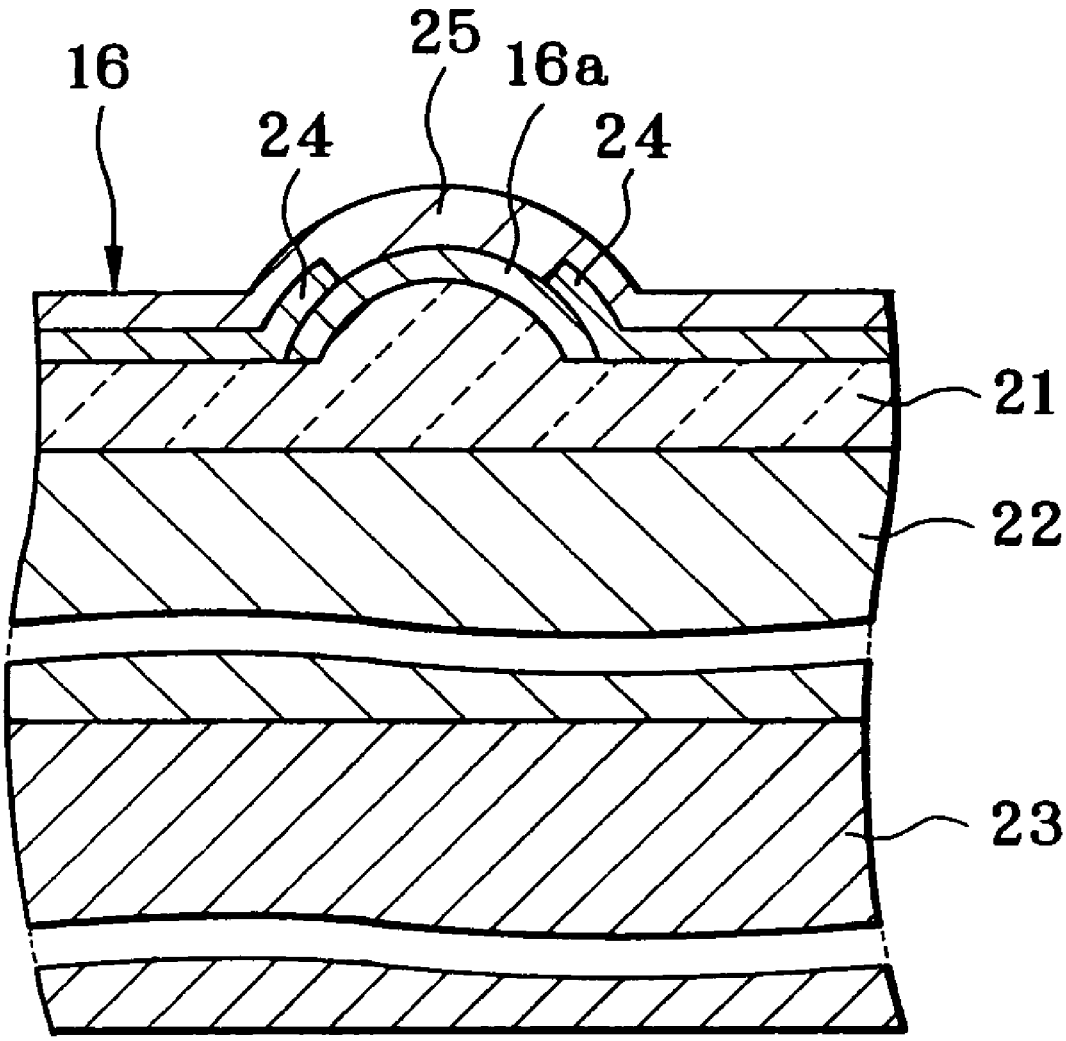
FIG. 3 is a cross section illustrating the thermal head.

The thermal head 16 extends in a main scan direction. A sub scan direction is defined to extend perpendicular to the main scan direction. The heating elements 16*a* are included in the thermal head 16 and arranged in one array in the main scan direction. In FIG. 3, the thermal head 16 includes the heating elements 16*a*, and has a glaze layer 21, a ceramic board 22 and an aluminum panel 23, which lies in an overlaid manner on one another. The glaze layer 21 is formed in the ceramic board 22. Electrodes 24 and the heating elements 16*a* are overlaid on the glaze layer 21. The electrodes 24 supply energy to the heating elements 16*a*. The heating elements 16*a* are constituted by resistors for heating. A protecting film 25 covers and protects the heating elements 16*a* and the electrodes 24. The aluminum panel 23 is a heat sink for dissipating heat in the thermal head 16, and is disposed behind the ceramic board 22.

As the heating elements 16*a* generate heat, the glaze layer 21, the ceramic board 22 and the aluminum panel 23 are caused to accumulate heat upon conduction of part of the heat from the heating elements 16*a*. Part of the accumulated heat in those layers influence to recording of pixels.

The heating elements 16*a* of the thermal head 16 are supplied with power determined according to bias data and image data, and generate heat energy in a controlled manner. In the printer, the number of times of driving the heating elements 16*a* is set equal to the number of heating depending on the combination of the bias data and the image data. An energy control circuit 27 controls a length of the driving time for each of the heating elements 16*a* for controlling the heat energy. Note that driving of the heating elements 16*a* can be controlled by any suitable methods, for example adjusting the number of times of driving, or adjusting a length of the driving time.

Figure 1:
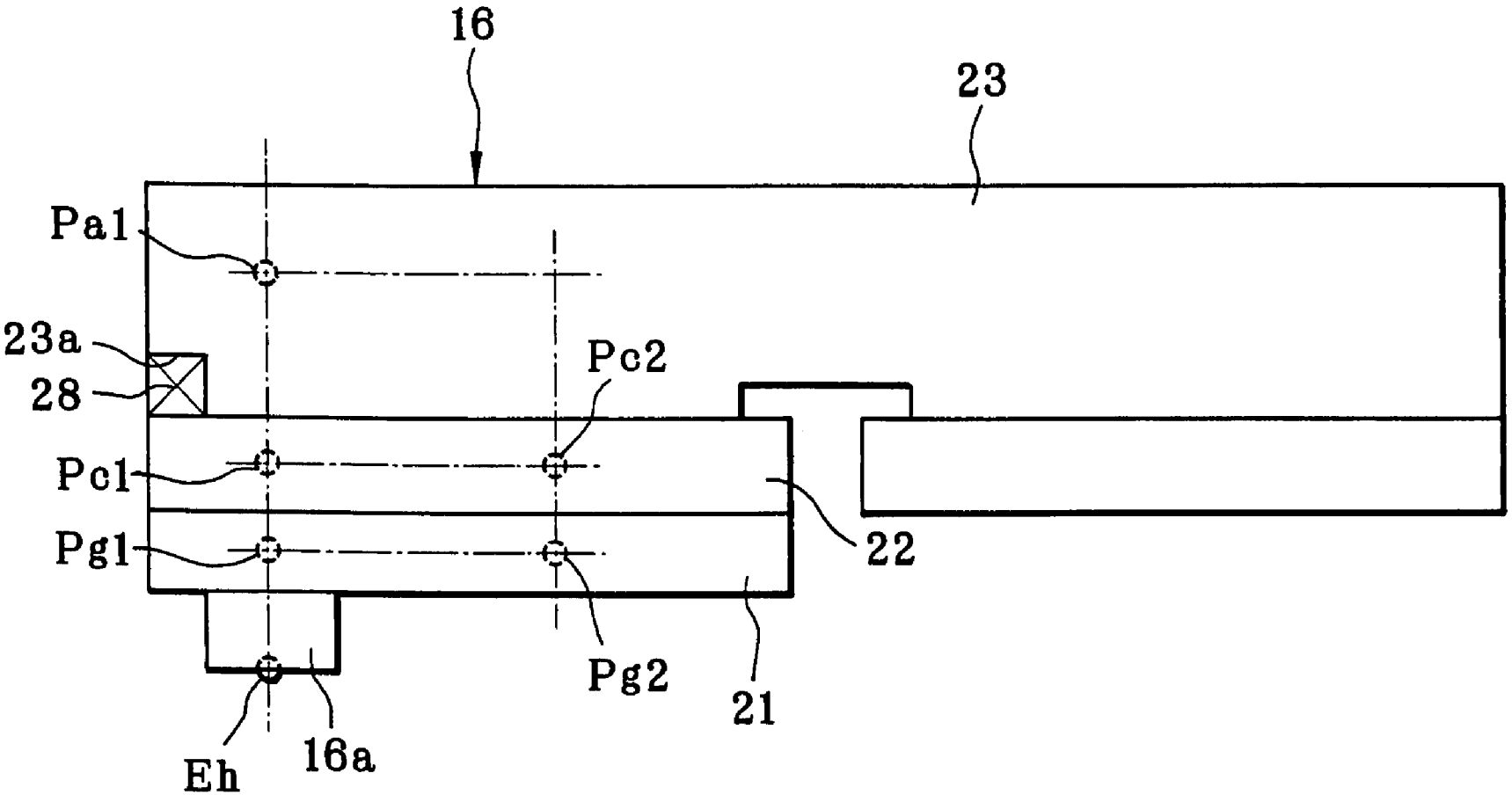
FIG. 1 is a side elevation illustrating a thermal head in which layers and specific points are defined.

In FIG. 1, a recess 23*a* is formed in the aluminum panel 23. A printhead temperature sensor 28 is contained in the aluminum panel 23. Note that a location of the printhead temperature sensor 28 is the most suitable according to highness of thermal conductivity. The best location of the printhead temperature sensor 28 can be directly higher than the thermal head 16 and within the aluminum panel 23. The printhead temperature sensor 28 measures temperature of the aluminum panel 23. In FIG. 2, an ambient temperature sensor 29 is disposed near to the thermal head 16. The ambient temperature sensor 29 measures temperature of the environment where the thermal head 16 lies. An example of the printhead temperature sensor 28 and the ambient temperature sensor 29 is a thermistor. Adhesive agent is used to attach the printhead temperature sensor 28, and is a material having high thermal conductivity for the purpose of accurately measuring temperature of the aluminum panel 23. Signals from the printhead temperature sensor 28 and the ambient temperature sensor 29 are sent to the correction device 12.

The correction device 12, in addition to the heat accumulation correction, determines the printhead voltage Vp according to outputs from the printhead temperature sensor 28 and the ambient temperature sensor 29 for application to the heating elements 16*a* of the thermal head 16. A regulator 30 is supplied with information of the printhead voltage Vp determined by the correction device 12. The regulator 30 is responsive to powering of the heating elements 16*a* to cause application of the printhead voltage Vp to the heating elements 16*a*.

Figure 4:
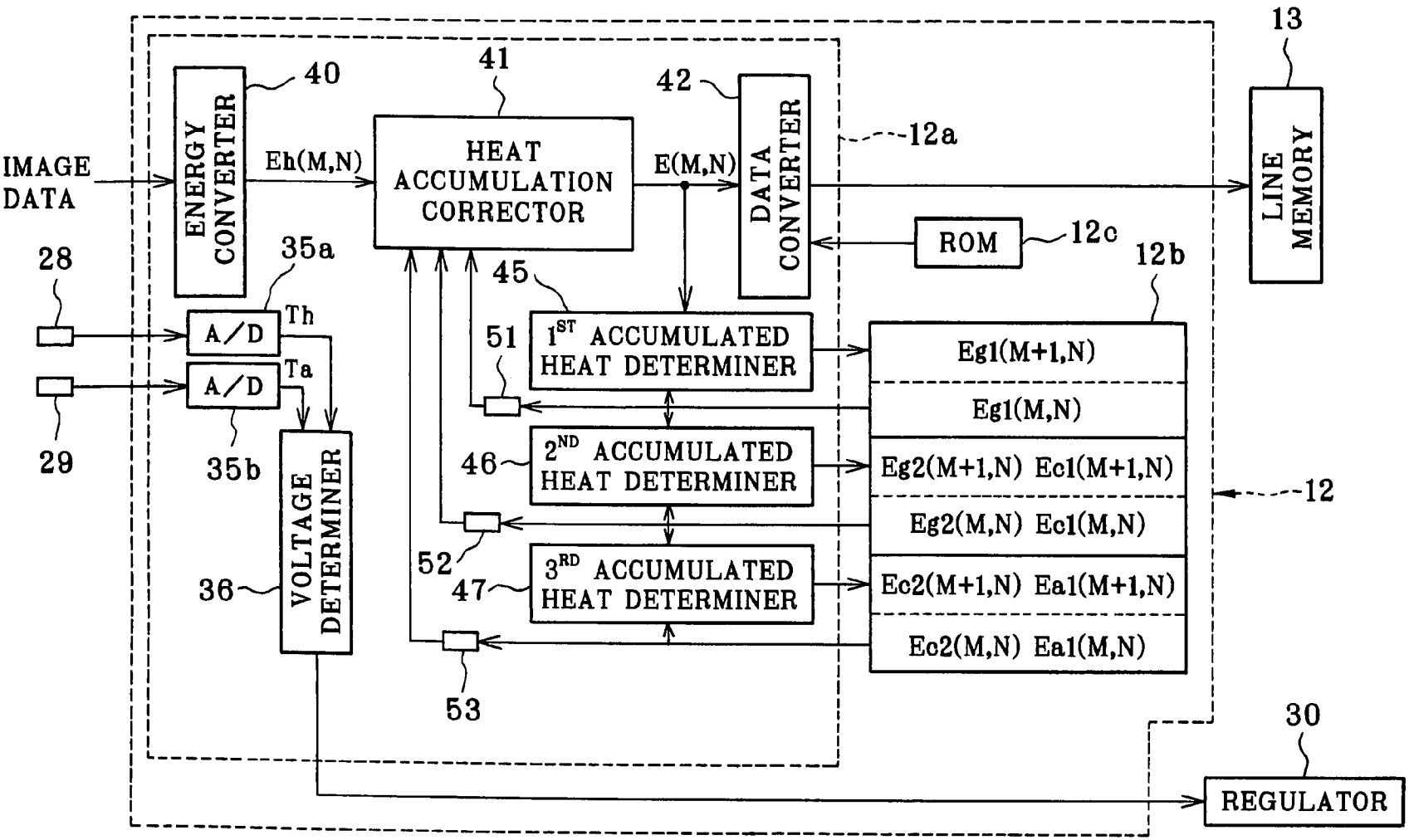
FIG. 4 is a block diagram schematically illustrating a correction device in the thermal printer.

In FIG. 4, circuits in the correction device 12 are schematically illustrated. The correction device 12 mainly includes CPU 12*a*, RAM 12*b* and ROM 12*c*. The RAM 12*b* stores various data in a temporary manner. The ROM 12*c* stores programs, coefficients and other information for the purpose of heat accumulation correction and calculation of printhead voltage Vp.

A/D converters 35*a* and 35*b* are incorporated in the CPU 12*a*, and supplied with signals from the printhead temperature sensor 28 and the ambient temperature sensor 29 for conversion into digital information of printhead temperature Th and ambient temperature Ta. A voltage determiner 36 is supplied with the digital information. The voltage determiner 36 uses a printhead voltage operating equation having the initial printhead voltage Vt as a parameter, and considers the printhead temperature Th and ambient temperature Ta by substitution in the equation. So a suitable printhead voltage Vp is calculated in correspondence with the detected printhead temperature Th and ambient temperature Ta. The reference printhead voltage Vt is a value predetermined so as to apply to the heating elements 16*a* when the printhead temperature Th and ambient temperature Ta are equal to a reference temperature Tt, namely when Th=Ta=Tt. In the present example, the reference temperature Tt is 23 deg. C. Information of the printhead voltage Vp determined by the voltage determiner 36 is sent to the regulator 30.

The printhead temperature sensor 28 and the ambient temperature sensor 29 are caused to measure temperature at the time of starting printing of each of the colors. The printhead voltage Vp is adjusted at each time of measuring temperature. During recording of one color, the heating elements 16*a* are driven electrically at an equal printhead voltage Vp.

An energy converter 40 is supplied with image data, and converts the same into initial heat data which represents coloring heat energy. The coloring heat energy is a sum of bias heat energy in the bias heating and the image heat energy in the image heating or gradation heating. A relationship between the image data and the coloring heat energy is determined according to coloring characteristic of the recording material 15. A heat accumulation corrector 41 is supplied with the initial heat data. Note that the conversion of the image data into the initial heat data is effective in performing the accumulated heat correction by simple calculation. If there is a linear relationship between heat energy generated by heating elements and any of the bias data and the image data, it is possible to use the bias data or image data as initial heat data.

The heat accumulation corrector 41 determines initial heat data and corrected heat data corrected according to first, second and third heat accumulation correcting data of heat energy conducted to the recording material 15 by the glaze layer 21, the ceramic board 22 and the aluminum panel 23. A data converter 42 is supplied with heat data corrected in the heat accumulation correction in the heat accumulation corrector 41.

The data converter 42 converts the heat data to image data in a manner inverse to the conversion in the energy converter 40. Coloring heat energy is represented in heat data. Bias heat energy of a constant level is subtracted from the coloring heat energy to obtain image heat energy. Then image data according to the image heat energy is created. It is possible to correct only image data in a manner inclusive of the bias data for the heat accumulation correction, without correcting bias data itself for the heat accumulation correction. It is to be noted in the invention that both of the bias data and the image data can be corrected separately in the heat accumulation correction, or the only the bias data can be corrected in the heat accumulation correction.

Figure 5:
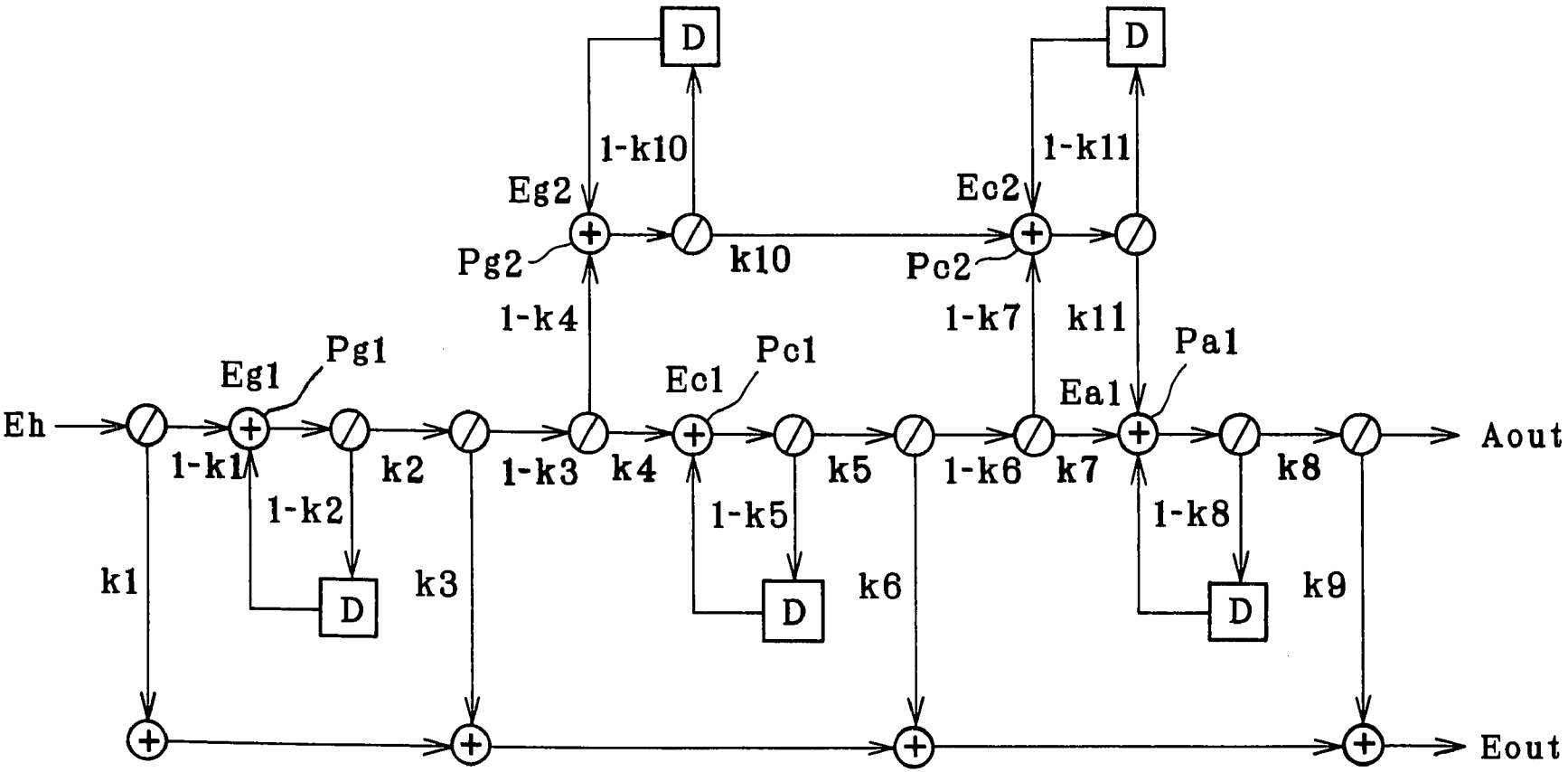
FIG. 5 is a block diagram schematically illustrating circuitry for correcting heat accumulation.
Figure 6:
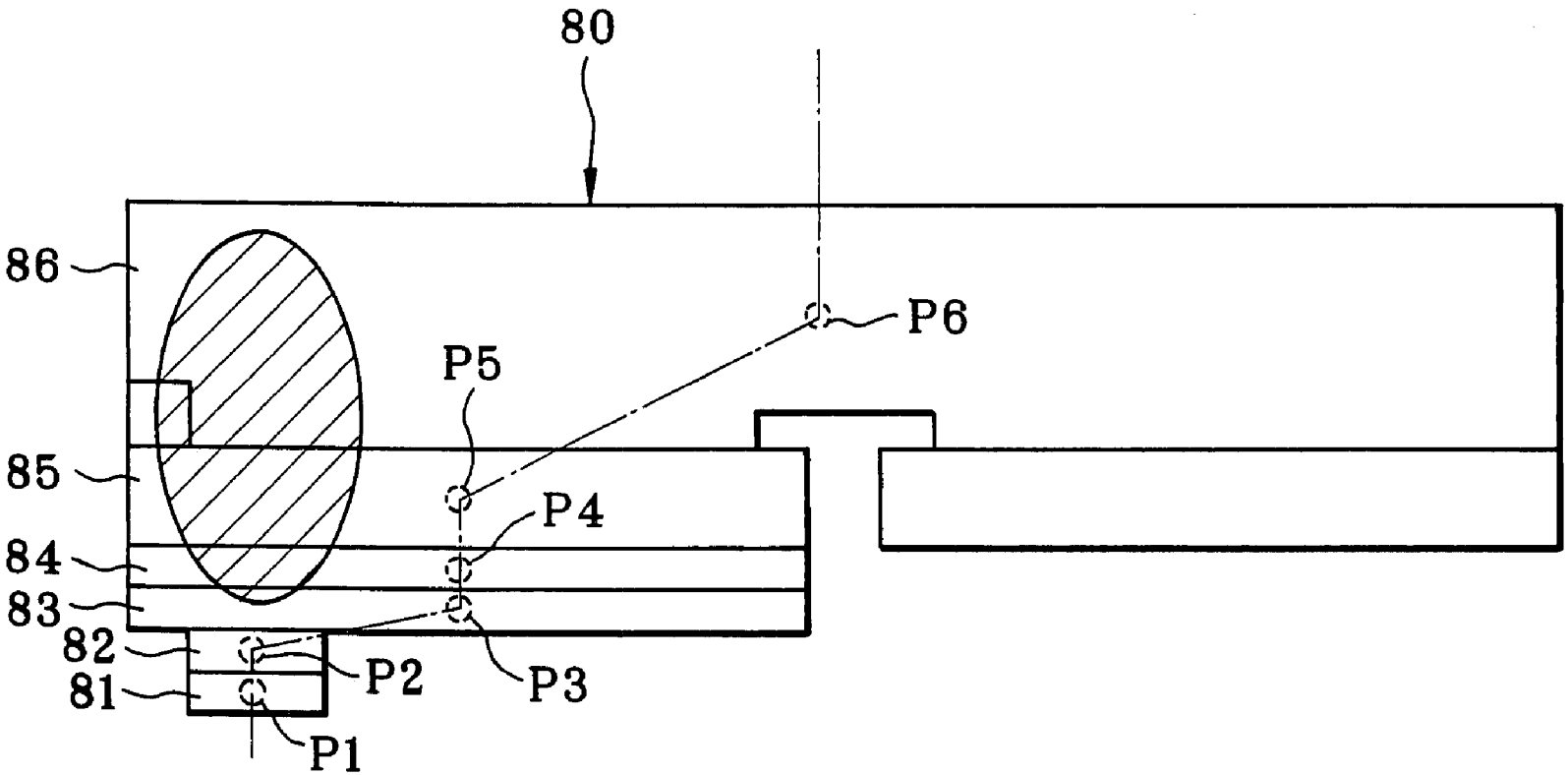
FIG. 6 (PRIOR ART)
FIG. 6 is a side elevation illustrating a thermal head of the prior art in which layers and specific points are defined.

In FIG. 5, circuits of the thermal head 16 are schematically illustrated. Part of heat accumulated in the glaze layer 21, the ceramic board 22 and the aluminum panel 23 is directly conducted to the recording material 15 and influences to recording. Thus, correction of heat accumulation is conceived according to the feature of the invention.

In FIG. 4, first, second and third accumulated heat determiners 45, 46 and 47 determine accumulated heat data Eg1, Eg2, Ec1, Ec2 and Ea1 (see FIG. 5) which are forms of the estimated heat accumulation expressed in the heat energy, the estimated heat accumulation at the points Pg1, Pg2, Pc1, Pc2 and Pa1 determined in the glaze layer 21, the ceramic board 22 and the aluminum panel 23 in FIG. 1. The accumulated heat data are stored in the RAM 12*b*, and renewed or updated at each time of the heat accumulation correction. In the embodiment of FIG. 1, a first specific point Pg1 is determined within the glaze layer 21 and on a line vertically extending from the heating elements 16*a*. A second specific point Pg2 is determined within the glaze layer 21 and offset from the first specific point Pg1 in the sub scan direction. Similarly, a first specific point Pc1 is determined within the ceramic board 22 and on a line vertically extending from the first specific point Pg1 of the glaze layer 21. A second specific point Pc2 is determined within the ceramic board 22 and offset from the first specific point Pc1 and higher than the second specific point Pg2. Similarly, a first specific point Pa1 is determined within the aluminum panel 23 and on a line vertically extending from the first specific point Pc1 of the glaze layer 21.

At the time of completing the heat accumulation correction for the initial heat data of the (M−1) line, the RAM 12*b* stores the accumulated heat data Eg1, Eg2, Ec1, Ec2, and Ea1. The accumulated heat data Eg1 of the Mth line for one line is information of an estimated heated state of the first specific point Pg1 of the glaze layer 21 upon completing recording of the (M−1) line. The accumulated heat data Eg2 of the Mth line for one line is information of an estimated heated state of the second specific point Pg2 of the glaze layer 21 upon completing recording of the (M−1) line. The accumulated heat data Ec1 of the Mth line for one line is information of an estimated heated state of the first specific point Pc1 of the ceramic board 22 upon completing recording of the (M−1) line. The accumulated heat data Ec2 of the Mth line for one line is information of an estimated heated state of the second specific point Pc2 of the ceramic board 22 upon completing recording of the (M−1) line. The accumulated heat data Ea1 of the Mth line for one line is information of an estimated heated state of the first specific point Pa1 of the aluminum panel 23 upon completing recording of the (M−1) line.

The first accumulated heat determiner 45 calculates accumulated heat data Eg1 of the first specific point Pg1 of the glaze layer 21. For the correction of accumulated heat regarding the initial heat data of the Mth line, accumulated heat data Eg1 for the Mth line is read from the RAM 12*b* one after another. The accumulated heat data Eg1 is sent to the first accumulated heat determiner 45, the second accumulated heat determiner 46 and the first multiplier 51. Also, the first accumulated heat determiner 45 is supplied with heat data for the Mth line after heat accumulation correction.

In FIG. 5, the first accumulated heat determiner 45 multiplies the heat data Eh by a coefficient (1−k1) at respective pixels, and obtains accumulated heat data representing heat energy which is included in that generated by the heating elements 16*a*, is short of developing color, and is conducted to the first specific point Pg1. Also, the first accumulated heat determiner 45 multiplies the accumulated heat data Eg1 by a coefficient (1−k2), and subjects the product of the multiplication to a time lag processing or first order delay processing, to obtain accumulated heat data representing heat energy which is residual at the first specific point Pg1. The accumulated heat data are added up by pixel to pixel correspondence, so a new set of the accumulated heat data Eg1 is written to the RAM 12*b*. The accumulated heat data Eg1 are used for heat accumulation correction of a succeeding line.

The second accumulated heat determiner 46 operates to calculate the accumulated heat data Eg2 of the second specific point Pg2 of the glaze layer 21, and the accumulated heat data Ec1 and the first specific point Pc1 of the ceramic board 22. In correcting the heat accumulation for the initial heat data of the Mth line, the accumulated heat data Eg2 and Ec1 for the Mth line are read from the RAM 12*b* sequentially. The second and third accumulated heat determiners 46 and 47 and a second multiplier 52 receive the accumulated heat data Eg2 and Ec1. The second accumulated heat determiner 46 is supplied with the accumulated heat data Eg1 for the Mth line read from the RAM 12*b*.

In FIG. 5, the second accumulated heat determiner 46 multiplies the accumulated heat data Eg1 by a coefficient k2.(1−k3).(1−k4), and obtains accumulated heat data representing heat energy which is included in that having been accumulated in the first specific point Pg1 of the glaze layer and is conducted to the first specific point Pc1. Also, the second accumulated heat determiner 46 multiplies the accumulated heat data Eg2 by a coefficient (1−k5), and subjects the product of the multiplication to a first order time lag processing or first order delay processing, to obtain accumulated heat data representing heat energy which is included in that having been accumulated in the first specific point Pc1 of the ceramic board 22 and is residual at the first specific point Pc1. The accumulated heat data are added up by pixel to pixel correspondence, so a new set of the accumulated heat data Ec1 is written to the RAM 12*b*. The accumulated heat data Ec1 are used for heat accumulation correction of a succeeding line.

The second accumulated heat determiner 46 multiplies the accumulated heat data Eg1 by a coefficient k2.(1−k3).(1−k4), and obtains accumulated heat data representing heat energy which is included in that having been accumulated in the first specific point Pg1 of the glaze layer and is conducted to the second specific point Pg2. Also, the second accumulated heat determiner 46 multiplies the accumulated heat data Eg2 by a coefficient (1−k10), and obtains accumulated heat data representing heat energy which is included in that having been accumulated in the second specific point Pg2 of the glaze layer and is residual at the second specific point Pg2. The accumulated heat data are added up by pixel to pixel correspondence, so a new set of the accumulated heat data Eg2 is written to the RAM 12*b*. The accumulated heat data Eg2 are used for heat accumulation correction of a succeeding line.

The third accumulated heat determiner 47 operates to calculate the accumulated heat data Ec2 of the second specific point Pc2 of the ceramic board 22, and the accumulated heat data Ea1 of the first specific point Pa1 of the aluminum panel 23. In correcting the heat accumulation for the initial heat data of the Mth line, the accumulated heat data Ec2 and Ea1 for the Mth line are read from the RAM 12*b* sequentially. The third accumulated heat determiner 47 and a third multiplier 53 receive the accumulated heat data Ec2 and Ea1. The third accumulated heat determiner 47 is supplied with the accumulated heat data Ec1 and Ec2 for the Mth line read from the RAM 12*b*.

In FIG. 5, the third accumulated heat determiner 47 multiplies the accumulated heat data Eg2 for the glaze layer 21 by the coefficient k10, and calculates accumulated heat data of heat energy conducted to and accumulated at the second specific point Pc2 of the ceramic board 22 upon conduction from the second specific point Pg2 of the glaze layer 21. The third accumulated heat determiner 47 multiplies the accumulated heat data Ec2 by the coefficient (1−k11), and calculates accumulated heat data of heat energy residual at the second specific point Pc2 of the ceramic board 22 without further conduction. Also, the third accumulated heat determiner 47 multiplies the accumulated heat data Ec1 by the coefficient k5(1−k6) (1−k7) for the ceramic board 22, and calculates accumulated heat data of heat energy accumulated at the second specific point Pc2 of the ceramic board 22 upon conduction from the first specific point Pc1 for the ceramic board 22. The accumulated heat data are added up in pixel to pixel correspondence, and written to the RAM 12*b* as accumulated heat data Ec2 of the ceramic board 22. The stored accumulated heat data Ec2 for the ceramic board 22 is used for correction of a succeeding line.

The third accumulated heat determiner 47 multiplies the accumulated heat data Ec1 for the ceramic board 22 by the coefficient k5(1−k6).k7, and calculates accumulated heat data of heat energy conducted to and accumulated at the specific point Pa1 of the aluminum panel 23 upon conduction from the second specific point Pc1 of the ceramic board 22. The third accumulated heat determiner 47 multiplies the accumulated heat data Ec2 by the coefficient k11, and calculates accumulated heat data of heat energy conducted to and accumulated at the specific point Pa1 of the aluminum panel 23 upon conduction from the second specific point Pc2. Also, the third accumulated heat determiner 47 multiplies the accumulated heat data Ea1 by the coefficient (1−k8) for the aluminum panel 23, and subjects the product of the multiplication to a first order time lag processing or first order delay processing, to obtain accumulated heat data of heat energy residual at the specific point Pa1 of the aluminum panel 23 without further conduction. The accumulated heat data are added up in pixel to pixel correspondence, and written to the RAM 12*b* as accumulated heat data Ea1.

The first, second and third multipliers 51, 52 and 53 multiply the first, second and third accumulated heat data from the RAM 12*b* by predetermined coefficients, to obtain first, second and third heat accumulation correcting data.

The first multiplier 51 multiplies the accumulated heat data Eg1 by the coefficient k2.k3, and obtains first heat accumulation correcting data representing heat energy having been accumulated in the glaze layer 21 and at a level developing color of the recording material 15 upon conduction from the heating elements 16*a*. The second multiplier 52 multiplies the accumulated heat data Ec1 by the coefficient k5.k6, and obtains second heat accumulation correcting data representing heat energy having been accumulated in the ceramic board 22 and at a level developing color of the recording material 15 upon conduction from the heating elements 16*a*.

The third multiplier 53 multiplies the accumulated heat data Ea1 by the coefficient k8.k9, and obtains third heat accumulation correcting data representing heat energy having been accumulated in the aluminum panel 23 and at a level developing color of the recording material 15 upon conduction from the heating elements 16*a*. The third multiplier 53 multiplies the accumulated heat data Ea1 by the coefficient k8(1−k9 ), and obtains heat data Aout of heat dissipated from the thermal head 16 into the atmosphere.

The first, second and third heat accumulation correcting data obtained by the first, second and third multipliers 51-53 are transmitted to the heat accumulation corrector 41 one after another. The heat accumulation corrector 41 adds up the first, second and third heat accumulation correcting data in pixel to pixel correspondence, and then subtracts the sum of the addition from the initial heat data. The heat accumulation corrector 41 divides a difference of the subtraction by a divisor k1, and obtains heat data of coloring heat energy which the heating elements 16*a* should generate according to the heat accumulation correction.

The correction of the initial heat data is effected according to Equation I. Accumulated heat data are renewed according to Equations II to VI.

$$E(M,N)=[Eh(M,N)-k2k3Eg1(M,N)-k5k6Ec1(M,N)-k8k9Ea1(M,N)]/k1 \quad (\ldots \text{I})$$

$$Eg1(M+1,N)=(1-k1).E(M,N)+(1-k2).Eg1(M,N) \quad (\ldots \text{II})$$

$$Eg2(M+1,N)=k2(1-k3)(1-k4).Eg1(M,N)+(1-k10).Eg2(M,N) \quad (\ldots \text{III})$$

$$Ec1(M+1,N)=k2(1-k3).k4.Eg1(M,N)+(1-k5).Ec1(M,N) \quad (\ldots IV)$$

$$Ec2(M+1,N)=k5(1-k6)(1-k7).Ec1(M,N)+k10.Eg2(M,N)+(1-k11).Ec2(M,N) \quad (\ldots V)$$

$$Ea1(M+1,N)=k5(1-k6).k7.Ec1(M,N)+k11.Ec2(M,N)+(1-k8).Ea1(M,N) \quad (\ldots VI)$$

In the equations, symbols have the following meanings.

M: the number of lines;

N: the number of data within one line associated with a heating element, or pixel number within one line;

E(M,N): heat data of an Nth pixel of an Mth line after heat accumulation correction;

Eh(M,N): initial heat data of the Nth pixel of the Mth line before heat accumulation correction;

Eg1(M,N): accumulated heat data of the Nth pixel of the Mth line in the glaze layer 21 at the first specific point and obtained in the correction of an (M−1)th line;

Eg2(M,N): accumulated heat data of the Nth pixel of the Mth line in the glaze layer 21 at the second specific point and obtained in the correction of the (M−1)th line;

Ec1(M,N): accumulated heat data of the Nth pixel of the Mth line in the ceramic board 22 at the first specific point and obtained in the correction of the (M−1)th line;

Ec2(M,N): accumulated heat data of the Nth pixel of the Mth line in the ceramic board 22 at the second specific point and obtained in the correction of the (M−1)th line;

Ea1(M,N): accumulated heat data of the Nth pixel of the Mth line in the aluminum panel 23 at the specific point and obtained in the correction of the (M−1)th line.

The coefficients k1-k11 are determined according to materials for the glaze layer 21, the ceramic board 22 and the aluminum panel 23, and their shape, thermal conductivity and other characteristics. Among those, the coefficient k1 depends upon the shape of the thermal head 16, the material of the recording material 15, and tendency in thermal conduction from the heating elements 16*a* to the glaze layer 21. The coefficient k1 is closer to zero (0) according to likeliness in accumulation of heat in the glaze layer 21.

The coefficients k2, k4 and k10 are determined according to the material of the glaze layer 21. The coefficient k3 is determined to a rate of thermal conduction from the glaze layer 21 to the recording material 15 and the ceramic board 22. The coefficient k2 is determined near to one (1) according to the degree of dissipation of heat from the glaze layer 21, namely smallness of residual heat in the glaze layer 21. The coefficient k4 is determined near to one (1) according to the smallness of conducted heat from the first specific point Pg1 to the second specific point Pg2 in the glaze layer 21. The coefficient k10 is determined near to one (1) according to the degree of dissipation of heat from the second specific point Pg2, namely smallness of residual heat in the second specific point Pg2. The coefficient k3 is determined near to one (1) according to a ratio of an amount of heat conducted to the recording material 15 to an amount of dissipated heat from the glaze layer 21.

The coefficients k5, k7 and k11 are determined according to the material of the ceramic board 22. The coefficient k6 is determined to a rate of thermal conduction from the ceramic board 22 to the recording material 15 and the aluminum panel 23. The coefficient k5 is determined near to one (1) according to the degree of dissipation of heat from the ceramic board 22, namely smallness of residual heat in the ceramic board 22. The coefficient k7 is determined near to one (1) according to the smallness of conducted heat from the first specific point Pc1 to the second specific point Pc2 in the ceramic board 22. The coefficient k11 is determined near to one (1) according to the degree of dissipation of heat from the second specific point Pc2, namely smallness of residual heat in the second specific point Pc2. The coefficient k6 is determined near to one (1) according to a ratio of an amount of heat conducted to the recording material 15 to an amount of dissipated heat from the ceramic board 22.

The coefficient k8 is determined according to the material of the aluminum panel 23. The coefficient k6 is determined to a rate of thermal conduction from the aluminum panel 23 to the recording material 15 and to the atmosphere. The coefficient k8 is determined near to one (1) according to the degree of dissipation of heat from the aluminum panel 23, namely smallness of residual heat in the aluminum panel 23. The coefficient k9 is determined near to one (1) according to a ratio of an amount of heat conducted to the recording material 15 to an amount of dissipated heat from the aluminum panel 23.

Equation I is obtained as follows. Let Eout(M,N) be heat data of heat energy applied by one of the heating elements 16*a* to the recording material 15 when the one of the heating elements 16*a* is driven for bias heating and image heating without correcting heat accumulation. Eout(M,N) is expressed as follows:

$$Eout(M,N)=k1Eh(M,N)+k2k3Eg1(M,N)+k5k6Ec1(M,N)+k8k9Ea1(M,N)$$

Heat energy required for application to the recording material 15 in order to color the recording material 15 at density according to image data is Eh(M,N). So the item Eh(M,N) is substituted for item Eout(M,N) in the above equation, and also the heat energy E(M,N) required in the heating elements 16*a* is substituted for the item Eh(M,N) on the right side. It is possible to obtain Equation I by finding the value of E(M,N) according to solution of the equation.

The operation of the above construction is described now. To print a full-color image, yellow, magenta and cyan image data of the image are written to the image memory 10, before a command signal of command of printing is generated. In response to this, the recording material 15 is moved to the thermal head 16, which is shifted down to the recording material 15 on its position of starting the printing. Then yellow recording is started.

When the yellow recording starts, signals from the printhead temperature sensor 28 and the ambient temperature sensor 29 are sent to the CPU 12*a*, and are converted by the A/D converters 35*a* and 35*b* into the printhead temperature Th and the temperature Ta. Information of the printhead temperature Th and the temperature Ta are transmitted to the voltage determiner 36.

The voltage determiner 36 determines the printhead voltage Vp for yellow recording by substitution of the printhead temperature Th and ambient temperature Ta in a predetermined printhead voltage equation. If the printhead temperature Th and ambient temperature Ta are equal to the reference temperature Tt, the printhead voltage Vp is set equal to the reference printhead voltage Vt. Obtained information of printhead voltage Vp is sent to the regulator 30, which is controlled for outputting the printhead voltage Vp.

Yellow image data of a first line is read from the image memory 10, and written to the line memory 11. After this, the yellow image data of the first line is read one pixel after another from the line memory 11, and transmitted to the correction device 12.

When the energy converter 40 is supplied with yellow image data of a first pixel of the first line, then the yellow image data is converted to initial heat data Eh(1,1) representing coloring heat energy, which is sent to the heat accumulation corrector 41.

When the initial heat data Eh(1,1) is input to the heat accumulation corrector 41, then accumulated heat data are read from the RAM 12*b*, including accumulated heat data Eg1(1,1), Eg2(1,1), Ec1(1,1), Ec2(1,1) and Ea1(1,1) for the first pixel of the first line. The accumulated heat data Eg1(1,1) is sent to the first accumulated heat determiner 45 and the second accumulated heat determiner 46 and the first multiplier 51. The accumulated heat data Eg2 (1,1) and Ec1 (1,1) are sent to the second accumulated heat determiner 46, the third accumulated heat determiner 47 and the second multiplier 52. The Ec2(1,1) and Ea1(1,1) are sent to respectively the third accumulated heat determiner 47 and the third multiplier 53.

The accumulated heat data Eg1(1,1) is multiplied by the coefficient k2k3 in the first multiplier 51 to obtain first heat accumulation correcting data k2k3Eg1(1,1). The accumulated heat data Ec1(1,1) is multiplied by the coefficient k5k6 to obtain second heat accumulation correcting data k5k6Ec1 (1,1). The accumulated heat data Ea1(1,1) is multiplied by the coefficient k8k9 to obtain third heat accumulation correcting data k8k9Ea1 (1,1). Those heat accumulation correcting data are sent to the heat accumulation corrector 41.

The heat accumulation corrector 41 adds up the first, second and third accumulated heat data of the first pixel, and then subtracts the sum of the addition from the initial heat data Eh(1,1). A difference obtained by the subtraction is divided by the divisor k1, to find the heat data E (1,1) as a corrected result of the heat accumulation correction in consideration of the printhead voltage Vp. The heat data is sent to the data converter 42 and the first accumulated heat determiner 45. The data converter 42 converts the heat data E(1,1) into corrected yellow image data according to the heat accumulation correction. The yellow image data is written to the line memory 13.

Upon receipt of the corrected heat data E(1,1), the first accumulated heat determiner 45 newly calculates the accumulated heat data Eg1(2,1) according to Equation II on the basis of the corrected heat data E(1,1) and the accumulated heat data Eg1(1,1). The second accumulated heat determiner 46 newly calculates the accumulated heat data Eg2(2,1) according to Equation III on the basis of the accumulated heat data Eg1 (1,1) and Eg2 (1,1). Also, the second accumulated heat determiner 46 calculates the accumulated heat data Ec1 (2,1) according to Equation IV on the basis of the accumulated heat data Eg1(1,1) and Ec1(1,1). The third accumulated heat determiner 47 newly calculates the accumulated heat data Ec2(2,1) according to Equation V on the basis of the accumulated heat data Eg2(1,1), Ec1(1,1) and Ec2(1,1) Also, the third accumulated heat determiner 47 calculates the accumulated heat data Ea1(2,1) according to Equation VI on the basis of the accumulated heat data Ec1(1,1), Ec2(1,1) and Ea1(1,1).

The accumulated heat data Eg1(2,1), Eg2(2,1), Ec1(2,1), Ec2(2,1) and Ea1(2,1) are overwritten for the first, second and third accumulated heat data of the first pixel, for renewal or updating of the data suitable for the second line. The estimated heated state of portions of the glaze layer 21, the ceramic board 22 and the aluminum panel 23 located at a first one of the heating elements 16*a* in one line is renewed.

Thus, the heat accumulation correction of yellow image data of a first pixel of a first line, and the renewal of the first, second and third accumulated heat data are completed. Then yellow image data of a second pixel is read from the line memory 11, sent to the energy converter 40 and converted into initial heat data Eh(1,2). The initial heat data Eh(1,2) is sent to the heat accumulation corrector 41.

Similarly, the first, second and third accumulated heat data Eg1(1,2), Eg2(1,2), Ec1(1,2), Ec2(1,2) and Ea1(1,2) for a second pixel are read from the RAM 12*b*, and sent to the first, second and third accumulated heat determiners 45-47 and the first, second and third multipliers 51-53. The first, second and third accumulated heat data Eg1(1,2), Ec1(1,2) and Ea1(1,2) are multiplied by respectively coefficients of k2k3, k5k6, and k8k9, to obtain first, second and third heat accumulation correcting data for the second pixel. Those are input to the heat accumulation corrector 41. The first, second and third heat accumulation correcting data of the second pixel are subtracted from the initial heat data of the second pixel. A difference of the subtraction is divided by the divisor k1, to obtain corrected heat data of the second pixel after the heat accumulation correction.

The heat data E(1,2) after the correction of the accumulated heat is sent to the data converter 42 and the first accumulated heat determiner 45. The heat data in the data converter 42 is converted to yellow image data, which is written to the line memory 13.

Upon receipt of the corrected heat data E(1,2) from the heat accumulation corrector 41, the first accumulated heat determiner 45 newly calculates the accumulated heat data Eg1(2,2) according to Equation II on the basis of the corrected heat data E(1,2) and the accumulated heat data Eg1(1,2). The second accumulated heat determiner 46 newly calculates the accumulated heat data Eg2 (2,2) according to Equation III on the basis of the accumulated heat data Eg1(1,2) and Eg2(1,2). Also, the second accumulated heat determiner 46 calculates the accumulated heat data Ec1(2,2) according to Equation IV on the basis of the accumulated heat data Eg1(1,2) and Ec1 (1,2). The third accumulated heat determiner 47 newly calculates the accumulated heat data Ec2(2,2) according to Equation V on the basis of the accumulated heat data Eg2(1,2), Ec1(1,2) and Ec2(1,2). Also, the third accumulated heat determiner 47 calculates the accumulated heat data Ea1(2,2) according to Equation VI on the basis of the accumulated heat data Ec1(1,2), Ec2(1,2) and Ea1(1,2).

Similarly, yellow image data for all pixels of the first line are corrected for heat accumulation correction. Estimated heat accumulation of the glaze layer 21, the ceramic board 22 and the aluminum panel 23 are renewed in correspondence with the heating elements 16*a*. When yellow image data of the one line is written to the line memory 13, the first line of the yellow image starts being recorded.

The printhead driver 14 receives bias data and a signal from the energy control circuit 27, and drives the heating elements 16*a* of the thermal head 16 equally at one time for generating heat in the bias heating. After this, yellow image data of one line from the line memory 13 is set in the printhead driver 14, which selectively drives the heating elements 16*a* according to a signal from the energy control circuit 27 and yellow image data, to develop gradation by image heating. In both of the bias heating and image heating, the printhead voltage Vp from the regulator 30 is applied to the heating elements 16*a*.

Part of the heat energy generated by the heating elements 16*a* is applied to the recording material 15, to develop the yellow color for printing a first line. Residual heat energy included in the generated heat energy is conducted to the glaze layer 21 and accumulated therein.

While the first line is recorded thermally, yellow image data of a second line is subjected to heat accumulation correction. In a similar manner to the first line, the yellow image data of the second line is written to the line memory 11, and then is read from the line memory 11 one after another for compensating for the heat accumulation correction in the correction device 12. Regarding the initial heat data of a first pixel of the second line, first, second and third heat accumulation correcting data are used as created by considering the first, second and third accumulated heat data Eg1(2,1), Eg2(2,1), Ec1(2,1), Ec2(2,1) and Ea1(2,1) after renewal in the heat accumulation correction of heat data of the first pixel of the first line. The corrected yellow image data after the heat accumulation correction is written to the line memory 13. The first, second and third accumulated heat data are renewed by use of the corrected heat data of the second line after the heat accumulation correction and first, second and third accumulated heat data renewed in correction of the first line.

When recording of the first line of the yellow image is completed, the recording material 15 is fed by one ling in the sub scan direction in a stepwise manner. The recording material 15 is heated by the bias heat energy according to bias data and image heat energy according to yellow image data for a second line after heat accumulation correction. A second line of the yellow image is recorded.

Similarly, remaining lines including a third line are recorded according to heat accumulation correction. At each time of heat accumulation correction, the first, second and third accumulated heat data are renewed.

The portion after yellow recording is subjected to application of ultraviolet rays of a wavelength specified for the yellow coloring layer, and is fixed. Yellow recording to a final one of the lines is completed, before photo fixation of the recording material 15 including its rear end is completed. Then the pressure with the thermal head 16 is discontinued. The recording material 15 is moved back. The start position of the recording material 15 for starting the recording is moved to reach the thermal head 16. Then the transport is stopped, to press the thermal head 16 against the recording material 15.

After the thermal head 16 is pressed, magenta recording is started. In a similar manner to the magenta recording, the temperature is measured by the printhead temperature sensor 28 and the ambient temperature sensor 29, to find the printhead temperature Th and ambient temperature Ta. The printhead voltage Vp is determined according to the printhead temperature Th and ambient temperature Ta. The regulator 30 is caused by the control to output the printhead voltage Vp.

Magenta image data is read from the image memory 10 by one line and written to the line memory 11. In a manner similar to a method for the yellow image data, the magenta image data are corrected in the heat accumulation correction. For recording of respective lines, bias heat energy for magenta is applied by bias heating, before image heat energy according to corrected magenta image data is applied by image heating. In the bias heating and image heating for the magenta recording, the printhead voltage Vp is applied to the heating elements 16*a* at a level determined initially in the magenta recording.

A portion with a magenta image is fixed by photo fixation with ultraviolet rays of a wavelength specific to the magenta coloring layer. When a final one of the lines of the magenta image is recorded, photo fixation is completely effected to the surface including a rear edge of the recording material 15. Then pressure with the thermal head 16 is discontinued. The recording material 15 is moved back. When the starting position of recording of the recording material 15 reaches the thermal head 16, the transport is stopped, to press the thermal head 16 on the recording material 15. After this, the cyan recording starts, so as to record a cyan image one line after another in the above-described manner.

It follows that the heat accumulation can be corrected acceptably, because the estimated heat accumulation of the glaze layer 21, the ceramic board 22 and the aluminum panel 23 are correctly estimated in relation to the thermal head 16 according to history of heating of the heating elements 16*a*. The colors can be developed at desired densities according to image data even though recording proceeds in the sub scan direction, because the heat accumulation is corrected according to the printhead voltage Vp applied to the heating elements 16*a*. Degradation of an image in the sub scan direction can be prevented.

Test recording was carried out as an experiment. A sample image having an equal density in the sub scan direction is printed. Even though the printhead voltage Vp changes according to the printhead temperature of the thermal head 16 and ambient temperature, printed density of the sample image was found equal in the sub scan direction. Also, the determination of the coefficients k1-k11 for the purpose of heat accumulation correction of first ambient temperature was effective in keeping image quality high without drop in the sub scan direction in a different temperature from the first ambient temperature.

In the above embodiment, the heat accumulating layers are three layers. However, heat accumulating layers in the invention can be two or four or more layers. Further, plural specific points disposed in the sub scan direction may be defined in place of the second specific point being single. In the above embodiment, one specific point is determined for the uppermost one of the heat accumulating layers. However, plural specific points can be determined for the uppermost heat accumulating layer. If plural specific points disposed in the sub scan direction are used, heat accumulation correcting data of layers for a succeeding line can be obtained according to accumulated heat data of the respective specific points.

In the above embodiment, the printer is the color thermal printer of the direct printing in which the thermal head develops color directly in a recording sheet. However, a printer of which accumulated head is compensated for can be a thermal printer of a sublimation type or other printing type. It is possible to suppress a drop of image quality in such a form as unwanted streaks with an unwanted high density.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A heat accumulation correcting method of correcting heat accumulation of a thermal head for thermal recording, wherein said thermal head has an array of heating elements arranged in a main scan direction, for image recording on recording material by one line in driving of said heating elements according to heat data, wherein one of said thermal head and said recording material is moved relative to a remaining one thereof in a sub scan direction in recording of said line, said heat accumulation correcting method comprising steps of:

wherein said thermal head has first to Lth heat accumulating layers lying over one another, said first layer having said heating elements thereon;

wherein a first specific point of said first to Lth layers is predetermined commonly behind said heating elements in a thickness direction thereof, and a second specific point is predetermined in at least one of said first to Lth layers and offset from said first specific point in said sub scan direction;

processing initial heat data of an Mth line, and heat accumulation correcting data for said first and second specific points in said first to Lth layers in relation to said Mth line, to determine said heat data adapted to driving said heating elements to print said Mth line; and processing said determined heat data and accumulated heat data related to heat accumulation of said first and second specific points of said first to Lth layers in printing said Mth line, according to a predetermined linear function, to determine accumulated heat data of said first and second specific points of said first to Lth layers for said (M+1)th line, and for multiplying said accumulated heat data by a coefficient, to determine heat accumulation correcting data for said (M+1)th line.

2. A heat accumulation correcting method as defined in claim 1, wherein said first to Lth heat accumulation correcting data for said Mth line are subtracted from said initial heat data of said Mth line at respective pixels, and a difference of said subtraction is divided by a coefficient, to determine said heat data.

3. A heat accumulation correcting method as defined in claim 1, wherein while said Mth line is recorded, said heat data of said (M+1)th line among plural lines to be recorded is corrected for heat accumulation correction according to said accumulated heat data.

4. A heat accumulation correcting method as defined in claim 1, wherein said accumulated heat data include:

first accumulated heat data related to estimated heat accumulation at said first specific point and within said first layer;

second accumulated heat data related to estimated heat accumulation at said second specific point and within said first layer;

third accumulated heat data related to estimated heat accumulation at one specific point, within said second layer and behind said first specific point;

said processing step to determine said accumulated heat data includes:

updating said first accumulated heat data by processing according to said initial heat data and a linear function;

updating said second accumulated heat data by processing according to said first accumulated heat data and a linear function; and updating said third accumulated heat data by processing according to said first accumulated heat data and a linear function, wherein said heat accumulation correcting data for said (M+1)th line is determined according to at least said first, second and third accumulated heat data after updating.

5. A heat accumulation correcting method of correcting heat accumulation of a thermal head for thermal recording, wherein said thermal head has an array of heating elements arranged in a main scan direction, for image recording on recording material by one line in driving of said heating elements according to heat data, wherein one of said thermal head and said recording material is moved relative to a remaining one thereof in a sub scan direction in recording of said line, said heat accumulation correcting method comprising steps of:

wherein said thermal head has first to Lth heat accumulating layers lying over one another, said first layer having said heating elements thereon;

wherein a first specific point of said first to Lth layers is predetermined commonly behind said heating elements in a thickness direction thereof, and a second specific point is predetermined in at least one of said first to Lth layers and offset from said first specific point in said sub scan direction;

in consideration of initial heat data of an Mth line, and heat accumulation correcting data for said first specific point in said first to Lth layers in relation to said Mth line, and heat accumulation correcting data for said second specific point in relation to said Mth line, determining said heat data adapted to driving said heating elements to print said Mth line;

processing said determined heat data and accumulated heat data Eg1 related to heat accumulation of said first specific point of said first layer in printing said Mth line, according to a predetermined linear function, to determine accumulated heat data Eg1 related to heat accumulation of said first specific point of said first layer for an (M+1)th line, and for multiplying said accumulated heat data Eg1 by a coefficient, to determine first heat accumulation correcting data for said (M+1)th line;

processing accumulated heat data Ec1 related to heat accumulation of said first specific point of a Pth one of said layers, and accumulated heat data E01 related to heat accumulation of said first specific point of a (P−1)th one of said layers, according to a predetermined linear function, to determine accumulated heat data Ec1 of said first specific point for said (M+1)th line, and for multiplying said accumulated heat data Ec1 by a coefficient, to determine Pth heat accumulation correcting data for said (M+1)th line, where P is one integer from 2 to L−1;

processing accumulated heat data Eg1 related to said heat accumulation of said first specific point of said first layer, and accumulated heat data Eg2 related to heat accumulation of said second specific point of said first layer, according to a predetermined linear function, to determine accumulated heat data Eg2 of said second specific point for said (M+1)th line, and also processing accumulated heat data Ec1 related to heat accumulation of said first specific point of said Pth layer, and accumulated heat data Ec2 related to heat accumulation of said second specific point of said Pth layer, and accumulated heat data E02 related to heat accumulation of said second specific point of said (P−1)th layer, according to a predetermined linear function, to determine accumulated heat data Ec2 of said second specific point for said (M+1)th line; and processing accumulated heat data Ea1 related to heat accumulation of said first specific point of said Lth layer, and accumulated heat data E11 and E12 related to heat accumulation of said first and second specific points of said (L−1)th layer, according to a predetermined linear function, to determine accumulated heat data Ea1 of said first specific point for said (M+1)th line, and for multiplying said accumulated heat data Ea1 by a coefficient, to determine Lth heat accumulation correcting data for said (M+1)th line.

6. A heat accumulation correcting method as defined in claim 5, wherein said first to Lth heat accumulation correcting data for said Mth line are subtracted from said initial heat data of said Mth line at respective pixels, and a difference of said subtraction is divided by a coefficient, to determine said heat data.

7. A heat accumulation correcting method as defined in claim 5, wherein while said Mth line is recorded, said heat data of said (M+1)th line among plural lines to be recorded is corrected for heat accumulation correction according to said accumulated heat data.

8. A heat accumulation correcting method as defined in claim 5, wherein L=3 and P=2, said first layer is a glaze layer, said second layer is a ceramic board, and said third layer is a panel of metal.

9. A thermal printer, including a thermal head having an array of heating elements arranged in a main scan direction, for image recording on recording material by one line in driving of said heating elements according to heat data, wherein one of said thermal head and said recording material is moved relative to a remaining one thereof in a sub scan direction in recording of said line, said thermal printer comprising:

wherein said thermal head has first to Lth heat accumulating layers lying over one another, said first layer having said heating elements thereon;

wherein a first specific point of said first to Lth layers is predetermined commonly behind said heating elements in a thickness direction thereof, and a second specific point is predetermined in at least one of said first to Lth layers and offset from said first specific point in said sub scan direction;

a heat accumulation corrector, responsive to initial heat data of an Mth line, and heat accumulation correcting data for said first and second specific points in said first to Lth layers in relation to said Mth line, for determining said heat data adapted to driving said heating elements to print said Mth line;

a determiner, responsive to said determined heat data and accumulated heat data related to heat accumulation of said first and second specific points of said first to Lth layers in printing said Mth line, for processing thereof according to a predetermined linear function, to determine accumulated heat data of said first and second specific points of said first to Lth layers for said (M+1)th line; and a multiplier for multiplying said accumulated heat data by a coefficient, to determine heat accumulation correcting data for said (M+1)th line.

10. A thermal printer as defined in claim 9, wherein said heat accumulation corrector subtracts said first to Lth heat accumulation correcting data for said Mth line from said initial heat data of said Mth line at respective pixels, and divides a difference of said subtraction by a coefficient, to determine said heat data.

11. A thermal printer as defined in claim 9, wherein while said Mth line is recorded, said heat data of said (M+1)th line among plural lines to be recorded is corrected for heat accumulation correction according to said accumulated heat data.

12. A thermal printer as defined in claim 9, wherein said accumulated heat data include:

first accumulated heat data related to estimated heat accumulation at said first specific point and within said first layer;

second accumulated heat data related to estimated heat accumulation at said second specific point and within said first layer;

third accumulated heat data related to estimated heat accumulation at one specific point, within said second layer and behind said first specific point;

said determiner updates said first accumulated heat data by processing according to said initial heat data and a linear function, updates said second accumulated heat data by processing according to said first accumulated heat data and a linear function, and updates said third accumulated heat data by processing according to said first accumulated heat data and a linear function, wherein said heat accumulation correcting data for said (M+1)th line is determined according to at least said first, second and third accumulated heat data after updating.

13. A thermal printer, including a thermal head having an array of heating elements arranged in a main scan direction, for image recording on recording material by one line in driving of said heating elements according to heat data, wherein one of said thermal head and said recording material is moved relative to a remaining one thereof in a sub scan direction in recording of said line, said thermal printer comprising:

wherein said thermal head has first to Lth heat accumulating layers lying over one another, said first layer having said heating elements thereon;

wherein a first specific point of said first to Lth layers is predetermined commonly behind said heating elements in a thickness direction thereof, and a second specific point is predetermined in at least one of said first to Lth layers and offset from said first specific point in said sub scan direction;

a heat accumulation corrector, responsive to initial heat data of an Mth line, and heat accumulation correcting data for said first specific point in said first to Lth layers in relation to said Mth line, and heat accumulation correcting data for said second specific point in relation to said Mth line, for determining said heat data adapted to driving said heating elements to print said Mth line;

a first determiner, responsive to said determined heat data and accumulated heat data Eg1 related to heat accumulation of said first specific point of said first layer in printing said Mth line, for processing thereof according to a predetermined linear function, to determine accumulated heat data Eg1 related to heat accumulation of said first specific point of said first layer for an (M+1)th line;

a first multiplier for multiplying said accumulated heat data Eg1 by a coefficient, to determine first heat accumulation correcting data for said (M+1)th line;

a Pth determiner, responsive to accumulated heat data Ec1 related to heat accumulation of said first specific point of a Pth one of said layers, and accumulated heat data E01 related to heat accumulation of said first specific point of a (P−1)th one of said layers, for processing thereof according to a predetermined linear function, to determine accumulated heat data Ec1 of said first specific point for said (M+1)th line, said Pth determiner being responsive to accumulated heat data Eg1 related to said heat accumulation of said first specific point of said first layer, and accumulated heat data Eg2 related to heat accumulation of said second specific point of said first layer, for processing thereof according to a predetermined linear function, to determine accumulated heat data Eg2 of said second specific point for said (M+1)th line, said Pth determiner being responsive to accumulated heat data Ec1 related to heat accumulation of said first specific point of said Pth layer, and accumulated heat data Ec2 related to heat accumulation of said second specific point of said Pth layer, and accumulated heat data E02 related to heat accumulation of said second specific point of said (P−1)th layer, for processing thereof according to a predetermined linear function, to determine accumulated heat data Ec2 of said second specific point for said (M+1)th line, where P is one integer from 2 to L−1;

a Pth multiplier for multiplying said accumulated heat data Ec1 by a coefficient, to determine Pth heat accumulation correcting data for said (M+1)th line;

an Lth determiner, responsive to accumulated heat data Ea1 related to heat accumulation of said first specific point of said Lth layer, and accumulated heat data E11 and E12 related to heat accumulation of said first and second specific points of said (L−1)th layer, for processing thereof according to a predetermined linear function, to determine accumulated heat data Ea1 of said first specific point for said (M+1)th line; and an Lth multiplier for multiplying said accumulated heat data Ea1 by a coefficient, to determine Lth heat accumulation correcting data for said (M+1)th line.

14. A thermal printer as defined in claim 13, wherein said heat accumulation corrector subtracts said first to Lth heat accumulation correcting data for said Mth line from said initial heat data of said Mth line at respective pixels, and divides a difference of said subtraction by a coefficient, to determine said heat data.

15. A thermal printer as defined in claim 13, wherein while said Mth line is recorded, said heat data of said (M+1)th line among plural lines to be recorded is corrected for heat accumulation correction according to said accumulated heat data.

16. A thermal printer as defined in claim 13, wherein L=3 and P=2, said first layer is a glaze layer, said second layer is a ceramic board, and said third layer is a panel of metal.

17. A computer readable medium storing a heat accumulation correcting computer-executable program for correcting heat accumulation of a thermal head for thermal recording, wherein said thermal head has an array of heating elements arranged in a main scan direction, for image recording on recording material by one line in driving of said heating elements according to heat data, wherein one of said thermal head and said recording material is moved relative to a remaining one thereof in a sub scan direction in recording of said line, said heat accumulation correcting computer-executable program comprising:

wherein said thermal head has first to Lth heat accumulating layers lying over one another, said first layer having said heating elements thereon;

wherein a first specific point of said first to Lth layers is predetermined commonly behind said heating elements in a thickness direction thereof, and a second specific point is predetermined in at least one of said first to Lth layers and offset from said first specific point in said sub scan direction;

a heat accumulation correcting code for processing initial heat data of an Mth line, and heat accumulation correcting data for said first and second specific points in said first to Lth layers in relation to said Mth line, to determine said heat data adapted to driving said heating elements to print said Mth line;

a determining code for processing said determined heat data and accumulated heat data related to heat accumulation of said first and second specific points of said first to Lth layers in printing said Mth line, according to a predetermined linear function, to determine accumulated heat data of said first and second specific points of said first to Lth layers for said (M+1)th line; and a multiplying code for multiplying said accumulated heat data by a coefficient, to determine heat accumulation correcting data for said (M+1)th line.

18. The computer readable medium storing the heat accumulation correcting computer-executable program as defined in claim 17, wherein said heat accumulation correcting code is for subtracting said first to Lth heat accumulation correcting data for said Mth line from said initial heat data of said Mth line at respective pixels, and dividing a difference of said subtraction by a coefficient, to determine said heat data.

19. The computer readable medium storing the heat accumulation correcting computer-executable program as defined in claim 17, wherein said accumulated heat data includes:

first accumulated heat data related to estimated heat accumulation at said first specific point and within said first layer;

second accumulated heat data related to estimated heat accumulation at said second specific point and within said first layer;

third accumulated heat data related to estimated heat accumulation at one specific point, within said second layer and behind said first specific point;

said determining code is for updating said first accumulated heat data by processing according to said initial heat data and a linear function, for updating said second accumulated heat data by processing according to said first accumulated heat data and a linear function, and for updating said third accumulated heat data by processing according to said first accumulated heat data and a linear function, wherein said heat accumulation correcting data for said (M+1)th line is determined according to at least said first, second and third accumulated heat data after updating.

20. A computer readable medium storing a heat accumulation correcting computer-executable program for correcting heat accumulation of a thermal head for thermal recording, wherein said thermal head has an array of heating elements arranged in a main scan direction, for image recording on recording material by one line in driving of said heating elements according to heat data, wherein one of said thermal head and said recording material is moved relative to a remaining one thereof in a sub scan direction in recording of said line, said heat accumulation correcting computer-executable program comprising:

wherein said thermal head has first to Lth heat accumulating layers lying over one another, said first layer having said heating elements thereon;

wherein a first specific point of said first to Lth layers is predetermined commonly behind said heating elements in a thickness direction thereof and a second specific point is predetermined in at least one of said first to Lth layers and offset from said first specific point in said sub scan direction;

a heat accumulation correcting code for processing initial heat data of an Mth line, and heat accumulation correcting data for said first specific point in said first to Lth layers in relation to said Mth line, and heat accumulation correcting data for said second specific point in relation to said Mth line, for determining said heat data adapted to driving said heating elements to print said Mth line;

a first determining code for processing said determined heat data and accumulated heat data Eg1 related to heat accumulation of said first specific point of said first layer in printing said Mth line, according to a predetermined linear function, to determine accumulated heat data Eg1 related to heat accumulation of said first specific point of said first layer for an (M+1)th line;

a first multiplying code for multiplying said accumulated heat data Eg1 by a coefficient, to determine first heat accumulation correcting data for said (M+1)th line;

a Pth determining code for processing accumulated heat data Ec1 related to heat accumulation of said first specific point of a Pth one of said layers, and accumulated heat data E01 related to heat accumulation of said first specific point of a (P−1)th one of said layers, according to a predetermined linear function, to determine accumulated heat data Ec1 of said first specific point for said (M+1)th line, said Pth determining code being for processing accumulated heat data Eg1 related to said heat accumulation of said first specific point of said first layer, and accumulated heat data Eg2 related to heat accumulation of said second specific point of said first layer, according to a predetermined linear function, to determine accumulated heat data Eg2 of said second specific point for said (M+1)th line, said Pth determining code being for processing accumulated heat data Ec1 related to heat accumulation of said first specific point of said Pth layer, and accumulated heat data Ec2 related to heat accumulation of said second specific point of said Pth layer, and accumulated heat data E02 related to heat accumulation of said second specific point of said (P−1) th layer, according to a predetermined linear function, to determine accumulated heat data Ec2 of said second specific point for said (M+1)th line, where P is one integer from 2 to L−1;

a Pth multiplying code for multiplying said accumulated heat data Ec1 by a coefficient, to determine Pth heat accumulation correcting data for said (M+1)th line;

an Lth determining code for processing accumulated heat data Ea1 related to heat accumulation of said first specific point of said Lth layer, and accumulated heat data E11 and E12 related to heat accumulation of said first and second specific points of said (L−1)th layer, according to a predetermined linear function, to determine accumulated heat data Ea1 of said first specific point for said (M+1)th line; and an Lth multiplying code for multiplying said accumulated heat data Ea1 by a coefficient, to determine Lth heat accumulation correcting data for said (M+1)th line.

* * * * *